US006577281B2

(12) United States Patent
Yamamoto et al.

(10) Patent No.: US 6,577,281 B2
(45) Date of Patent: Jun. 10, 2003

(54) ANTENNA DRIVE DEVICE AND ARTIFICIAL SATELLITE TRACKING SYSTEM USING THE SAME

(75) Inventors: Hiroshi Yamamoto, Tsuchiura (JP); Satoshi Sugawara, Hitachi (JP); Satoshi Shimizu, Mito (JP)

(73) Assignee: Hitachi, Ltd., Tokyo (JP)

( * ) Notice: Subject to any disclaimer, the term of this patent is extended or adjusted under 35 U.S.C. 154(b) by 77 days.

(21) Appl. No.: 09/812,775

(22) Filed: Mar. 15, 2001

(65) Prior Publication Data

US 2001/0028327 A1 Oct. 11, 2001

(51) Int. Cl.[7] ..... H01Q 3/00
(52) U.S. Cl. ..... 343/766; 343/763; 343/713
(58) Field of Search ..... 343/758, 757, 343/761, 763, 765, 766, 711, 713, 878, 880, 881, 882; H01Q 3/00

(56) References Cited

U.S. PATENT DOCUMENTS

| | | | | |
|---|---|---|---|---|
| 5,227,806 A | * | 7/1993 | Eguchi | 343/765 |
| 5,359,337 A | * | 10/1994 | Eguchi | 343/765 |
| 5,673,057 A | * | 9/1997 | Toland et al. | 343/761 |
| 5,729,240 A | * | 3/1998 | Bourgeois | 343/763 |
| 6,243,046 B1 | * | 6/2001 | Aoki | 343/765 |
| 6,310,582 B1 | * | 10/2001 | Uetake et al. | 343/765 |

* cited by examiner

*Primary Examiner*—Hoanganh Le
(74) *Attorney, Agent, or Firm*—Antonelli, Terry, Stout & Kraus, LLP

(57) ABSTRACT

At least one antenna is supported on a fixed supporting portion by an oscillating mechanism having rotational degrees of freedom on a X-Y plane, and a drive mechanism such as a drive motor is arranged in the vicinity of the oscillating center axis whereby the elevation angle and the azimuth angle of the antenna can be controlled.

14 Claims, 6 Drawing Sheets

FIG. 7

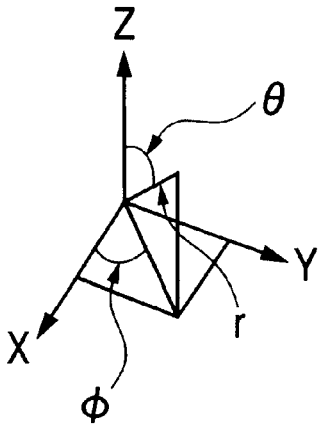

$$\left.\begin{aligned} X &= r * \sin\theta * \cos\phi \\ Y &= r * \sin\theta * \sin\phi \\ Z &= r * \cos\theta \end{aligned}\right\} 130$$

$$\begin{pmatrix} X \\ Y \\ Z \\ 1 \end{pmatrix} = \mathrm{Rot}\ (X, b)\ \mathrm{Rot}\ (Y, a) \begin{pmatrix} 0 \\ 0 \\ r \\ 1 \end{pmatrix} \quad \cdots \quad 131$$

$$\mathrm{Rot}\ (X, b) = \begin{pmatrix} 1 & 0 & 0 & 0 \\ 0 & \cos[b] & -\sin[b] & 0 \\ 0 & \sin[b] & \cos[b] & 0 \\ 0 & 0 & 0 & 1 \end{pmatrix} \quad \cdots \quad 132$$

$$\mathrm{Rot}\ (Y, a) = \begin{pmatrix} \cos[a] & 0 & \sin[a] & 0 \\ 0 & 1 & 0 & 0 \\ -\sin[a] & 0 & \cos[a] & 0 \\ 0 & 0 & 0 & 1 \end{pmatrix} \quad \cdots \quad 133$$

ANTENNA DRIVE DEVICE AND ARTIFICIAL SATELLITE TRACKING SYSTEM USING THE SAME

BACKGROUND OF THE INVENTION

The present invention relates to an artificial satellite tracking system which is mounted on a mobile body movable from one place to another place and controls the attitude of a communication antenna such that the antenna is directed to a communication satellite or the like, and more particularly to an X-Y mount type antenna drive mechanism which drives the antenna.

In an antenna supporting mechanism of an antenna drive system for attitude angle control of antenna which is fixedly mounted on the ground or is mounted on a mobile body such as an automobile, the most popular structure is an Azimuth-Elevation (hereinafter abbreviated "AZ-EL") mount, an X-Z mount or a theodolite which is described on page 194 of "Artificial satellite" written by Hiroshi Tsuru (published by Kogaku Tosho Kabushiki Kaisha in 1983). Alternately, the most popular structure may be a structure called an X-Y mount that is described on page 194 or page 195 of the same literature.

In an artificial satellite having a low elevation angle such as a broadcasting satellite on a geostationary orbit, the communication radio waves are often interrupted in an urban district having many tower buildings so that it is difficult to obtain high-quality communication with less interruption of communication radio waves. The high quality communication can be realized by making use of an artificial satellite having a high elevation angle in the zenith direction (a semi-geostationary orbit artificial satellite such as a semi-zenith artificial satellite or an extended elliptical orbit artificial satellite). However, the conventional tracking system for such an artificial satellite having a high elevation angle has the following tasks.

With respect to the AZ-EL mount of the prior art, in tracking of the artificial satellite in the zenith direction, there has been a drawback that an axial speed in the azimuth angle is increased and hence, the possible tracking range is restricted. However, since no consideration has been paid to the expansion of the possible tracking range, there exists a task that the restriction on an artificial satellite that can be tracked must be removed. Further, an AZ axis (an Azimuth axis) is required to have a rotational angle of not less than 360 degrees and hence, a rotary-type wave guide for transmitting transmission/reception signals from an antenna to a mobile body becomes necessary. However, no consideration has been paid to the quality of the signal transmission such that the rotary-type wave guide has a large transmission loss and further no small-sized and light-weighted wave guide that can transmit two ways comprised of transmission and reception has been developed. Accordingly, there exists a task that the transmission loss must be reduced.

On the other hand, with respect to the X-Y mount of the prior art, when the artificial satellite passes in the vicinity of the zenith, a situation that the axial speed in the azimuth angle is extremely increased as in the case of the AZ-EL mount can be obviated. Accordingly, this X-Y mount is applicable to the continuous tracking of an artificial satellite disposed at a position having a large elevation angle.

However, in the oscillating axes arrangement of the X-Y mount of the prior art, since the oscillating rotary center axes of an X axis and a Y axis are not present on a same plane, a drive mechanism such as a drive motor for the Y axis is inevitably mounted above a rotary mechanism relevant to the X axis so that it gives rise to a so-called two-storied constitution. Accordingly, a mechanical portion becomes large-sized and hence, when the mechanical portion is mounted on a mobile body, the maximum vehicle height becomes high and an antenna may largely extend from the vehicle width depending on the axial direction. Accordingly, it is often the case that an antenna portion is accommodated in the mobile body when the mobile body is traveling and the antenna is extended and used when the mobile body is stopped. Further, no consideration has been made with respect to enabling the tracking of an artificial satellite by the mobile body during the traveling and hence, there exists a task that the mechanism must be small-sized and light-weighted. To consider the fact that the mechanism is mounted on the mobile body, two points are important. That is, the height of the device is important from the viewpoint of the wind pressure and the traveling stability and the weight of the device is important in view of the withstanding load of a ceiling of the mobile body.

SUMMARY OF THE INVENTION

Provided that the antenna per se is not changed, by reviewing the constitution and the arrangement of drive systems such as drive motors for operating the antenna and the weight balancing of members provided for mounting them, it becomes possible to make the device small-sized and light-weighted.

It is an object of the present invention to make a mechanical system small-sized and light-weighted by optimizing the constitution, the arrangement and the weight balancing of a drive system of an antenna mechanism for supporting transmission/reception antennas whereby a high quality communication can be realized by tracking a semi-geostationary orbit artificial satellite such as an extended elliptical orbit artificial satellite or a semi-zenith artificial satellite from a traveling mobile body.

To achieve the above-mentioned object, in an X-Y mount type antenna drive device comprising an antenna portion which includes an antenna capable of performing at least either one of transmission or reception, a fixed supporting portion which supports the antenna portion, and a oscillating mechanism which is disposed between the antenna portion and the fixed supporting portion and has rotational degrees of freedom on an X-Y plane parallel to a plane of the antenna, the antenna drive device further comprises an antenna supporting portion which supports the antenna portion, a first oscillating mechanism portion which oscillates the antenna portion and the antenna supporting portion about a first oscillating axis, and a second oscillating mechanism portion which oscillates the first oscillating mechanism portion relative to the fixed supporting portion about a second oscillating axis, and the center of gravity of the first oscillating mechanism portion is disposed in the vicinity of an oscillating center line of the second oscillating axis. Due to such a constitution, the center of gravity of the first oscillating mechanism approaches the oscillating center axis of the second oscillating mechanism so that the moment of inertia can be reduced whereby it becomes possible to reduce the required torque of drive motors and the size of motors and to make the mechanism portion small-sized and light-weighted. Accordingly, it is preferable to arrange a heavy X-axis motor above the oscillating center axis of the Y-axis.

Further, to achieve the above-mentioned object, the oscillating center axis can be in the same member. Due to such a constitution, if the antenna is supported by two parts such as antenna supporting longitudinal plates connecting an antenna to a first oscillating mechanism portion, the deviation of axis between the antenna supporting longitudinal plates can be eliminated and hence, the shaft strength is increased. Further, since the axial alignment becomes unnecessary, the assembling of the device starting from a base portion becomes facilitated thus enhancing the reliability and maintenance of the device.

Additionally, to achieve the above-mentioned object, adapters disposed between the antenna supporting longitudinal plates of antenna supporting portion and the oscillating center axis may be preferably replaceable. By using the adapters disposed in the midst of the antenna supporting longitudinal plates replaceable, the adjustment of the operating range becomes possible without changing the drive mechanism of X-Y axes or the antenna supporting portion so that the standardization becomes possible and the cost can be reduced.

Further, to achieve the above-mentioned object, the antenna holding plate portion of the antenna supporting portion for holding the transmission and reception antennas may have a circular disc shape in place of a rectangular parallelepiped shape. This can be achieved by cutting and rounding four corners of the rectangular parallelepiped of the holding plate portion. The position of the oscillating center axis in the operation state just before a holding plate portion holding the antenna as a part of the antenna supporting portion interferes with a constituent member such as an antenna base (e.g. a pedestal) becomes the height of the oscillating center axis and is used as a base for calculating the device height of the whole antenna mechanism. When the both X-Y axes approach the operational limit, the holding plate portion interferes with the antenna base or the like and this interference depends on the length of a diagonal line of the antenna holding plate. Accordingly, by providing the shape of the holding plate portion as a circular shape, the length of the diagonal line can be shortened and hence, the device height of the whole antenna mechanism can be decreased.

Further, to achieve the above-mentioned object, a control of the antenna may preferably be performed such that the first and second oscillating axes are driven by converting command values in a form of an azimuth angle and an elevation angle into oscillating angles of the first and second oscillating axes so as to control the azimuth angle and the elevation angle of the antenna. By operating the antenna in response to the command values of the azimuth angle and the elevation angle, the artificial satellite tracking system can be used as a mount mechanism of an X-Z form, whereby the applicability of the system can be enlarged.

Additionally, to achieve the above-mentioned object, in an artificial satellite tracking system according to the present invention comprising antennas that transmit and receive radio waves with respect to an artificial satellite, an antenna drive mechanism that drives the antennas with rotational degrees of freedom on an X-Y plane parallel to an antenna plane, a control part that performs a drive control of the antenna drive mechanism in response to signals received by the antennas, and a communication equipment that performs communication with the artificial satellite through the antennas, the antenna drive mechanism includes an antenna holding portion holding the antennas, supporting legs supporting the antenna holding portion, an X-axis base portion tiltably holding the antennas by way of the supporting legs, an X-axis drive motor mounted in a space defined by the supporting legs on the X-axis base portion and drives the supporting legs, and a fixed supporting portion having a oscillating mechanism that oscillates the X-axis base portion relative to a Y-axis that passes through the X-axis drive motor or is disposed above the X-axis drive motor.

BRIEF DESCRIPTION OF THE DRAWINGS

FIG. 7 is equations for converting the elevation angle and the azimuth angle of the present invention into the rotation angles of X-axis and Y-axis.

DETAILED DESCRIPTION OF THE PREFERRED AND ALTERNATE EMBODIMENTS

Figure 1:
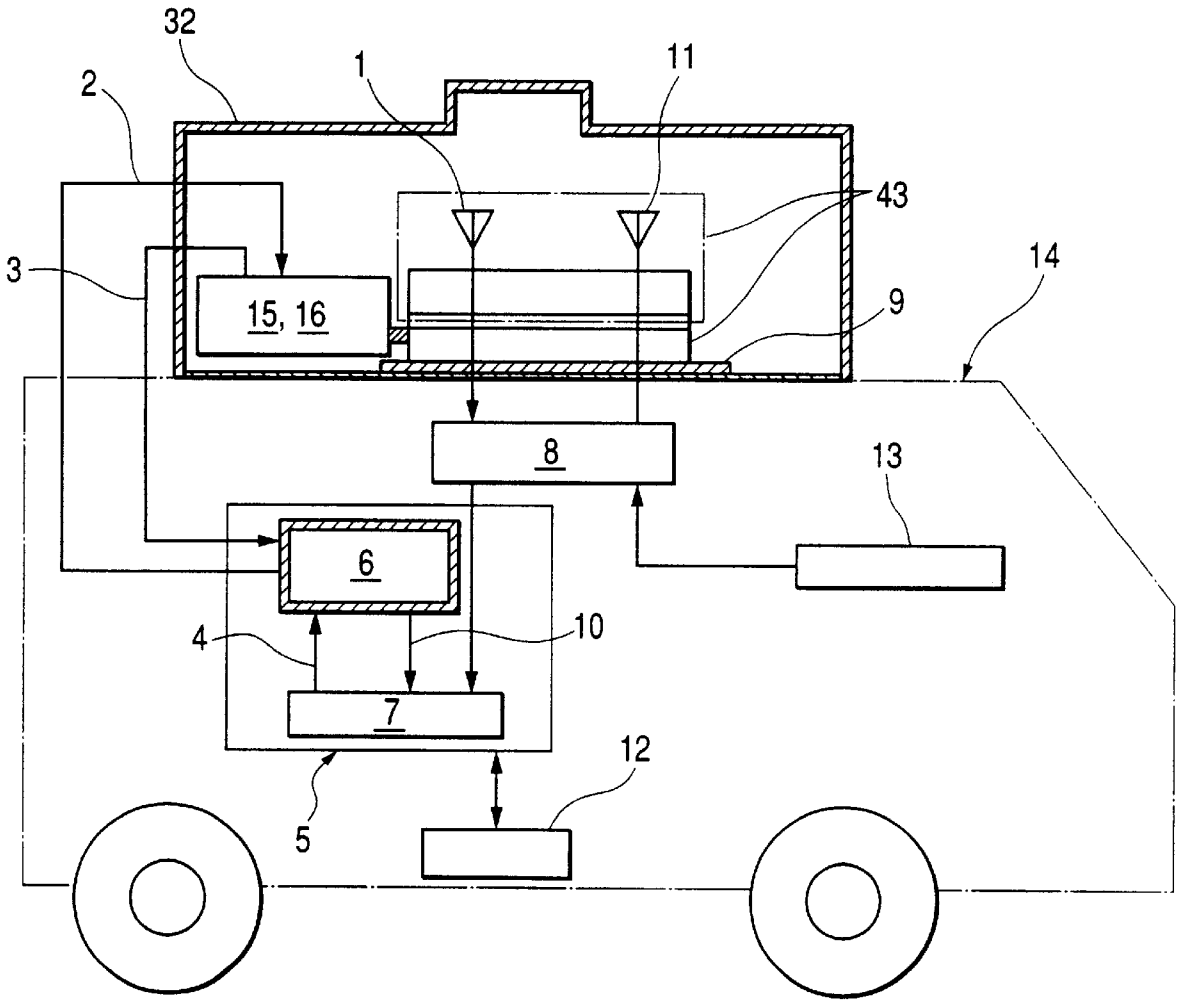
FIG. 1 is a view showing an equipment constitution of an artificial satellite communication system mounted on a mobile body.

Hereinafter, an embodiment of the present invention is explained in conjunction with FIG. 1 and other ensuing drawings. An equipment constitution of a communication system for tracking an artificial satellite that is mounted on a mobile body is shown in FIG. 1. The main constitution of the equipment constitution is comprised of a measuring equipment 13 such as a camera for collecting image data, a communication equipment 8 for performing the transmission and reception of the image data or the like, drivers 15, 16 for controlling a drive system of an antenna, an antenna drive mechanism 43, and a control unit 5 for controlling the whole communication system.

An antenna drive mechanism 43 and the drivers 15, 16 which drive transmission/reception antennas 1, 11 are arranged over the mobile body 14, while amplifiers and similar equipment for amplifying or converting transmission/reception signals are arranged on a rear surface of the antenna. These antenna drive system arranged over the mobile body are fixedly secured to the mobile body by means of a base 9. Further, the whole antenna drive system is covered with a radome 32 so as to enhance the environmental resistance.

The control unit 5 of the whole system is arranged in the inside of the mobile body. In the inside of the control unit 5, a tracking control part 7 which calculates an elevation angle and an azimuth angle based on received signals and a servo control part 6 which controls the drive system in response to an elevation angle and azimuth angle command 4 instructed by the tracking control part 7 are arranged. The servo control part 6 performs a control such that the current elevation angle and azimuth angle 10 of an antenna calculated based on an antenna position signal 3 follow or approach the instructed elevation angle and azimuth angle command 4 and transfers the current elevation angle and azimuth angle 10 to the tracking control part 7. The control unit 5 is connected with a control panel 12 so that the turning on of a power source and the operation condition are displayed on the control panel 12.

Figure 2:
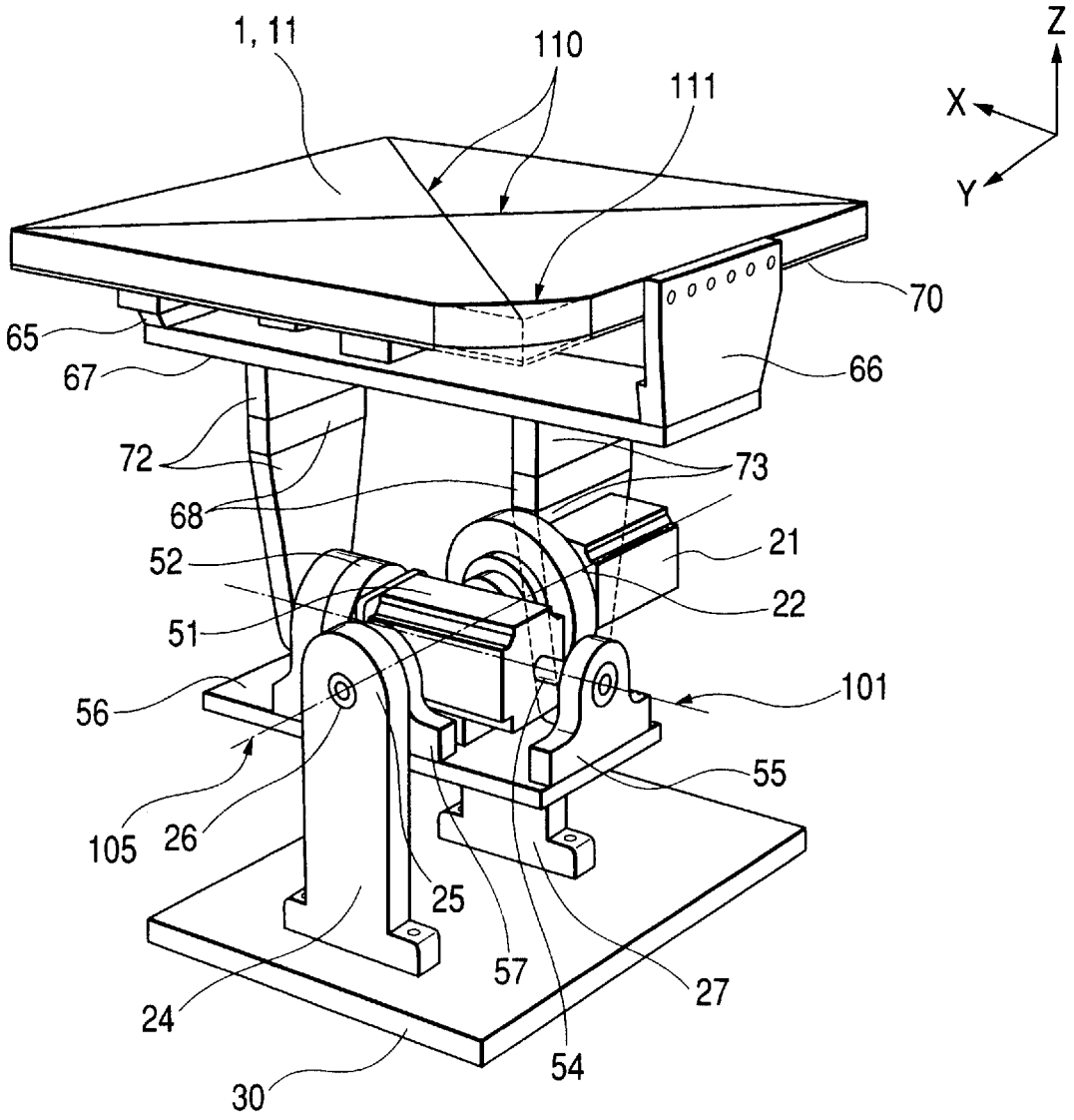
FIG. 2 is a perspective view of an antenna mechanism according to an embodiment of the present invention.

Subsequently, the antenna mechanism of the present invention that supports the transmission antenna 1 and the reception antenna 11 is explained hereinafter. FIG. 2 is a perspective view showing the relationship among encased constitutional elements and the antenna mechanism of the present invention.

As the overall constitution, the antenna mechanism is roughly comprised of an antenna portion including antennas and amplifiers and similar equipment, an antenna supporting portion holding the antenna portion, an X-axis base portion including a drive system and a mechanism for oscillating the antenna portion and the antenna supporting portion about an X axis, a drive system and a mechanism for oscillating the X-axis base portion about a Y axis, a base 9 constituting a mounting interface with the mobile body, and a fixed supporting portion made of a base block 30.

The antenna portion includes the transmission antenna 1 and the reception antenna 11 and a unit disposed behind the antenna is comprised of a transmission amplifier for transmission, a reception amplifier for reception and a transmission coil not shown in the drawing.

Since the transmission and reception antennas 1, 11 of the antenna portion respectively constitute unitary bodies and hence do not have sufficient strength, they are supported on an antenna holding plate 70 of the antenna supporting portion.

The antenna supporting portion is comprised of a pair of antenna supporting longitudinal plates 65, 66 which support the antenna holding plate 70 holding the antennas 1, 11 in pair, an amplifier supporting lateral plate 67 which holds the antenna supporting longitudinal plates 65, 66 and a pair of antenna supporting longitudinal plates 72, 73 which support the amplifier supporting lateral plate 67 in pair and are constituted such that they are respectively formed by connecting middle portions thereof by adapters 68 which divide them.

In the antenna portion, the antenna supporting longitudinal plate 65, the antenna supporting longitudinal plate 66 and the amplifier supporting lateral plate 67 constitute a box structure so as to hold the antenna portion. To prevent the transmission loss of the radio waves, the transmission and reception amplifiers are mounted on the amplifier supporting lateral plate 67 in the vicinity of the antenna portion although it is hidden in the antenna portion in the drawing.

As in the case of the AZ-EL mount system which has been explained with respect to the prior art, a mechanism system which requires infinite rotation is not present in the space from the transmission and reception antennas to the base 9 and signal cables can be wired along the antenna supporting portions or the like.

The transmission and reception antennas 1, 11 and the X-axis base portion which includes the drive mechanism are connected by the antenna supporting longitudinal plate 72 and the antenna supporting longitudinal plate 73 which is partially shown by a broken line. The replaceable adapters 68 which are shown by a chain line are mounted on the antenna supporting longitudinal plates.

Figure 6:
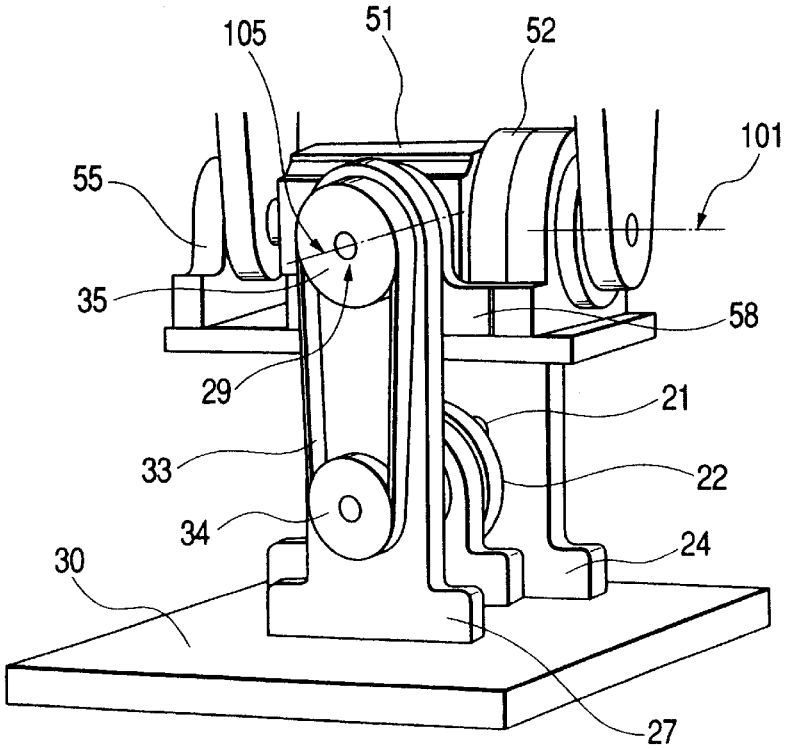
FIG. 6 is a perspective view showing another embodiment that separates a Y-axis power transmission system of the present invention.

The X-axis base portion which oscillates the antenna portion and the like about the oscillating center axis 101 of the X axis is constituted by a drive system such as a motor or the like and a mechanical portion such as a shaft. The drive system is comprised of an X-axis motor 51 that is rotated in response to a command from the driver 15 and an X-axis speed reduction gear 52. When the drive motor is a servomotor, a motor position detector such as an encoder for control is mounted on the drive motor. Further, to assist the holding torque at the time of stopping, a brake may be mounted on the drive motor. The mechanism portion is comprised of a bearing portion 55 disposed at the antenna support portion side for supporting the antenna portion, an X-axis shaft 54, and a bearing portion 57 disposed at the fixed supporting portion side and a bearing portion 58 disposed at the fixed supporting portion side which are connected to the fixed supporting portion. The bearing for the X-axis reduction gear 52 also works as a bearing disposed opposite to the bearing 55 disposed at the antenna support portion side for supporting the antenna portion. The X-axis base portion and the fixed supporting portion are connected by the bearing portion 57 disposed at the fixed supporting portion side and the bearing portion 58 disposed at the fixed supporting portion side by way of the shaft. The bearing portion 58 disposed at the fixed supporting portion side is shown in FIG. 6.

The fixed supporting portion which oscillates the antenna portion, the X-axis base portion and the like about the oscillating center axis 105 of the Y axis is, as shown in FIG. 2, comprised of a drive system such as a motor, a mechanism portion such as a shaft and an interface portion with the mobile body. The drive system includes a Y-axis drive motor 21 driven in response to a command from the driver 16 and a Y-axis reduction gear 22. When the drive motor is a servomotor, a motor position detector such as an encoder for control use is mounted. Further, to assist the holding torque at the time of stopping, a brake may be mounted on the drive motor. The mechanism portion is comprised of a bearing portion 25 at an X-axis base portion side which supports the X-axis base portion, a Y-axis shaft 26, a support strut 24 and a support strut 27 which support the X-axis base portion from a base block 30. The bearing portions are mounted on the support strut 24 and the support strut 27. In this embodiment, as in the case of the X axis, a drive system is arranged on the oscillating center axis 105 of the Y-axis and hence, a Y-axis drive motor 21 and a Y-axis speed reduction gear 22 are protruded in a negative direction of the Y axis from the support strut 27.

A bearing for the Y-axis speed reduction gear 22 is also used as a bearing at a side opposite to the bearing portion 25 of the X-axis base portion side. A Y-axis shaft 26 spans a space between the bearing portion 25 and a bearing portion 57 of a fixed supporting portion side of the X-axis base portion.

Figure 3:
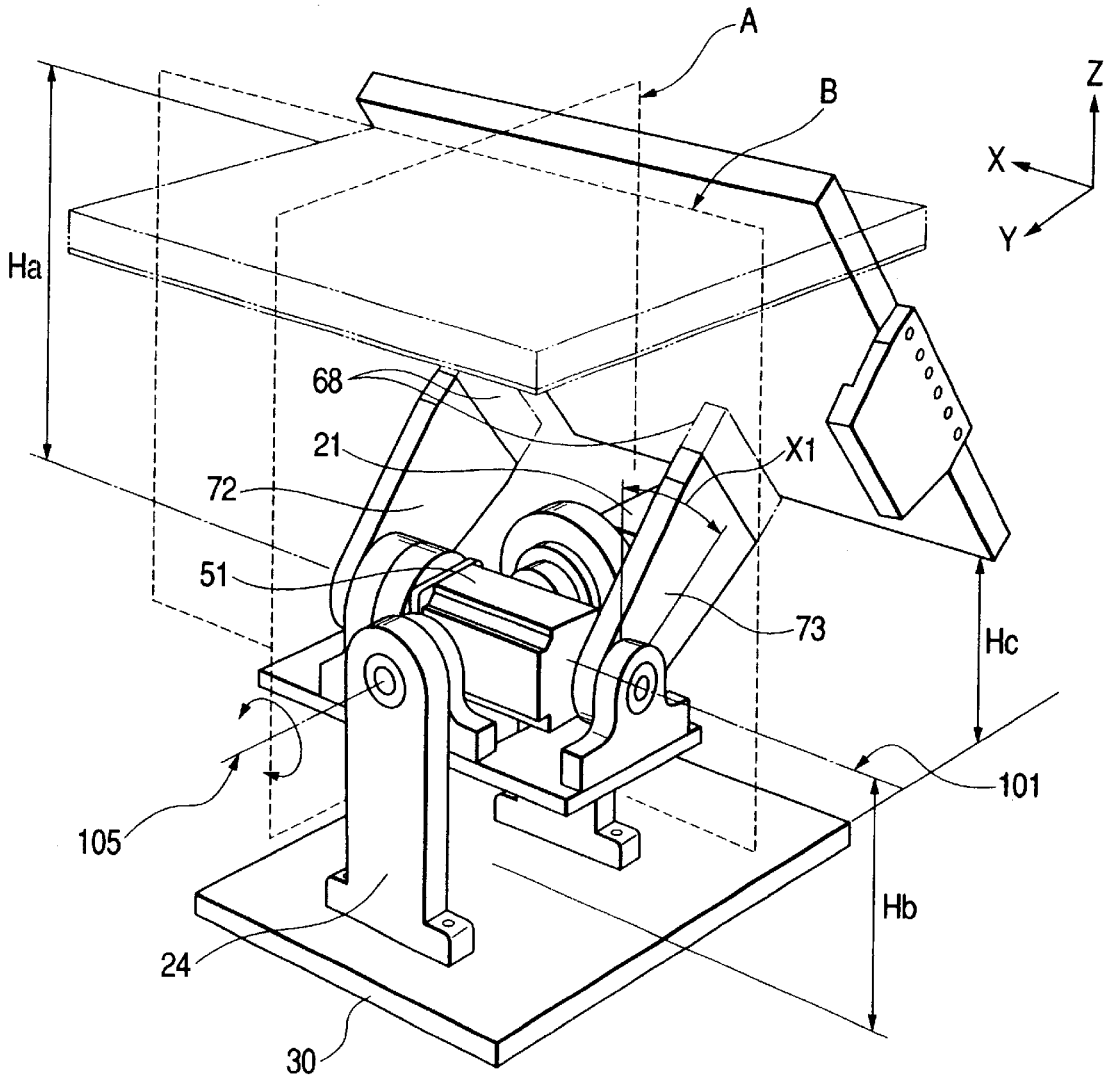
FIG. 3 is a perspective view of the embodiment of the present invention when an antenna portion is tilted about an X-axis.

Subsequently, the operation state (about the X axis) when the antenna portion and the antenna supporting portion are tilted is mentioned. A perspective view when the antenna portion and the antenna supporting portion are tilted by X1 degrees is shown in FIG. 3. For explanation purposes, members which constitute a portion of the antenna portion and the antenna supporting portion such as the amplifier supporting lateral plate 67 and the like are omitted. As shown in the drawing, the antenna portion and the antenna supporting portion are tilted to an operation limit angle of the X axis about the oscillating center axis 101 of the X axis. Taking into account the fact that the antenna portion and the antenna supporting portion are mounted on the vehicle as mentioned previously, the height of the antenna drive mechanism is the sum of the height Ha between the antenna surface and the oscillating center axis 101 of the X axis and the height Hb between a base block 30 and the oscillating center axis 101 of the X axis.

To reduce the height of the antenna drive mechanism, it is necessary to make Ha, Hb short. The shortest distance that prevents the antenna supporting portion from coming into contact with the Y-axis drive motor 21 and the like when the X axis is tilted becomes Ha.

Subsequently, by limiting the explanation to the operation of X axis for brevity, the height Hb between the base block 30 and the oscillating center axis 101 of the X axis is the height when the distance Hc between the antenna and the base block 30 becomes zero when the X axis is tilted to the operational limit.

The role of the adapters 68 which make the antenna portion shown by a chain line replaceable is as follows. Depending on the elevation angle of an artificial satellite that constitutes a subject of tracking or a site where the system is used, there is a possibility that a tracking operation range is changed. In such a case, to prevent the antenna supporting portion from coming into contact with the base block 30 when the antenna supporting portion is tilted, it is necessary to adjust the height of the antenna supporting portion. The antenna height can be adjusted by mounting or dismounting these adapters 68. With such a provision, it is unnecessary to prepare and exchange the antenna supporting longitudinal plates having different lengths from each other corresponding to the range of elevation angle of the artificial satellite which is a target of the tracking and hence, the cost reduction derived from the standardization of the constitutional components becomes possible.

In FIG. 2, to explain the structure of the X-axis shaft 54, a portion of the antenna supporting longitudinal plate 73 is shown by broken line. The X-axis shaft 54 is a single shaft that penetrates from the antenna supporting longitudinal plate 72 to the antenna supporting longitudinal plate 73 through the X-axis reduction gear 52 and the X-axis motor 51. When the shaft is divided in two, the two shafts have to bear cantilever loads thus giving rise to the reduction of the shaft strength. With the use of a single shaft, compared to the two separate shafts, the shaft strength can be enhanced resulting in the use of a shaft having a narrow diameter whereby the weight can be reduced.

Subsequently, the arrangement of center of gravity of the antenna portion, the antenna supporting portion and the X-axis base portion is explained. First of all, referring to FIG. 3, the weight balancing about the oscillating center axes 101, 105 of the X-axis and the Y-axis is explained. The load driven by the X-axis drive motor 51 is the antenna portion and the antenna supporting portion. To consider the Z-Y plane indicated by A which is perpendicular to the oscillating center axis 101 of the X axis, the drive torque about the X axis is substantially determined by the length of a moment arm from the oscillating center axis 101 of the X axis to the center of gravity of the antenna portion and the antenna supporting portion and the magnitude of the moment of inertia about the oscillating center axis 101 of the X axis. That is, if the center of gravity can be arranged at an optimum position by arranging constitutional components, the selection of a light-weight and small-sized drive motor having a small output shaft torque becomes possible. Such an arrangement has an advantageous effect to realize the reduction of weight of the antenna drive mechanism that is important when considering the case that the antenna drive mechanism is mounted on the vehicle is taken into consideration.

To consider the weight balancing with respect to the X axis, as can be understood from FIG. 3, since the members arranged in the negative direction of the Z axis as seen from the oscillating center axis 101 of the X axis are small in number, there is no case that the center of gravity of the antenna portion and the antenna supporting portion in the Z-axis direction exists in the vicinity of the X-axis oscillating center axis 101. The weight balancing may be possible when, as in the case of the X-Y mount mechanism described in the prior art, the antenna supporting longitudinal plates are protruded in the negative direction of the Z axis from the X-axis oscillating center axis 101 and a balance weight is arranged there. However, the moment of inertia about the X-axis oscillating axis is increased to the contrary and hence, the provision is not effective for the reduction of the required motor output torque. Furthermore, the protruded portions interfere with the supporting struts and hence, the restriction on the operation range is increased. Accordingly, rather than the weight balancing of the antenna portion and the antenna supporting portion which are relatively light in weight, the distribution of the weight including the X-axis base portion which includes the large-weighted X-axis drive motor about the Y axis becomes more important.

To consider the distribution of the weight about the Y axis, as mentioned previously, on an X-Z plane indicated by B which is perpendicular to the oscillating center axis 105 of the Y axis, the magnitude of the distance from the oscillating center axis 105 of the Y axis to the position of the center of gravity of the antenna portion, the antenna supporting portion and the X-axis base portion is relevant to the magnitude of the load torque of the Y-axis drive motor. Accordingly, by arranging the large-weight X-axis drive motor 51 at a position which passes the oscillating center axis of the Y-axis, that is, between the antenna support plate 65 and the antenna support plate 66, the length of the moment arm about the Y axis can be shortened so that the rated torque of the motor can be suppressed to a low value.

Figure 4:
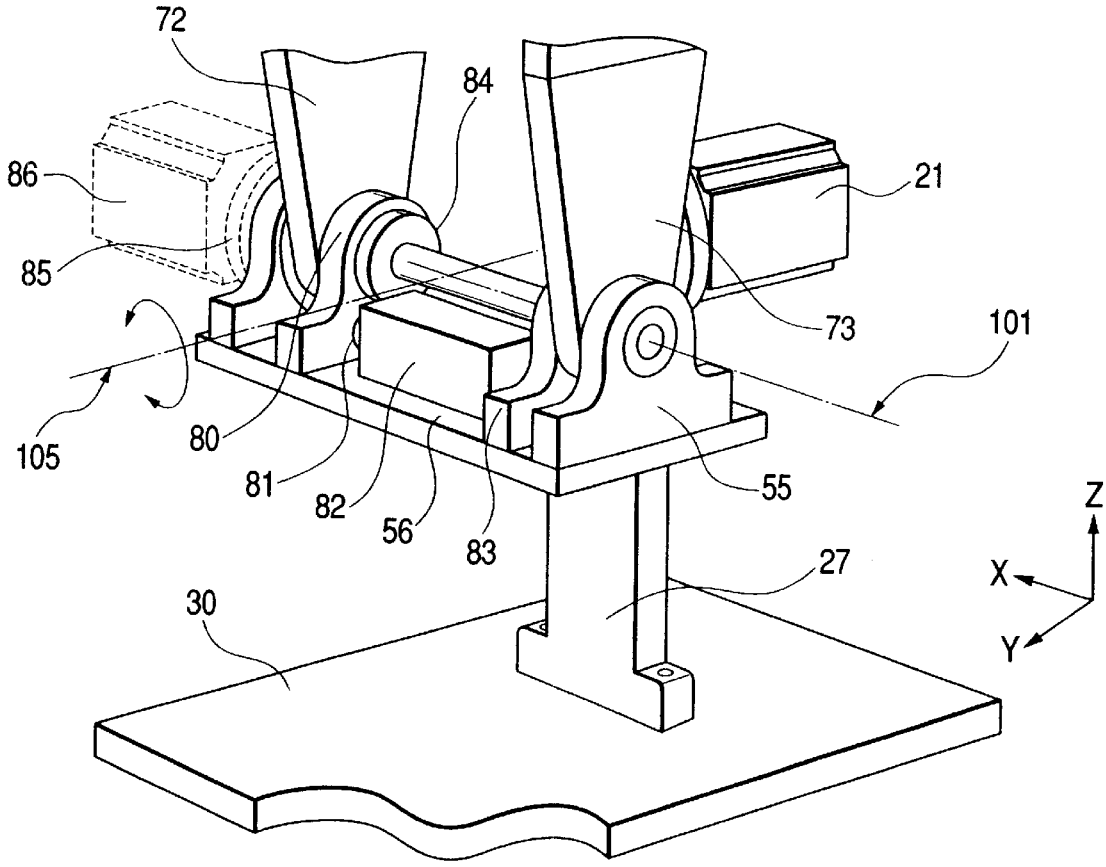
FIG. 4 is a perspective view showing the motor arrangement when X-Y axes do not intersect on the same plane.

The motor arrangement of the prior art in which the X-Y axes do not intersect on the same plane is explained in conjunction with FIG. 4. In FIG. 4, for explanation purposes, the constitution of a fixed supporting portion is shown with a portion thereof omitted. An X-axis drive motor 86 indicated by the broken line depicts the position where the motor is arranged in the prior art. The X-axis drive motor 86 of the prior art is arranged at the outer portion of the base 56 together with a motor supporting bearing portion 85 and constitutes a drive system which oscillates an antenna supporting longitudinal plate 72 by way of a reduction gear directly connected to the motor and a shaft. By comparing the arrangement position of the X-axis drive motor 51 with the arrangement position of the X-axis drive motor 86 indicated by the broken line in FIG. 4, the difference in distance in the X-axis direction from the center axis 105 of the Y axis between them can be readily understood. The position of the center of gravity in the Y-axis direction perpendicular to the X-Z plane does not influence the rated torque of the motor and acceleration torque of the Y-axis drive motor.

Another embodiment of the arrangement of the X-axis drive motor is also shown in FIG. 4. This embodiment is an embodiment where the oscillating center axis 105 of the Y-axis and the oscillating center axis 101 of the X-axis do not cross each other on the same plane. In this case where the weight of the antenna portion and the antenna supporting portion is relatively large, the X-axis drive motor 82 which is indicated by a solid line in FIG. 4 is arranged below the oscillating center axis 105 of the Y axis for balancing the weight. The position of the center of gravity of the X-axis base portion which includes the X-axis drive motor 82 and the like is also arranged on the X-Z plane perpendicular to the oscillating center axis 105 of the Y axis and at the position where the moment arm from the oscillating center axis 105 of the Y axis is short, that is, between the antenna supporting plate 65 and the antenna supporting plate 66. Since the X-axis drive motor 82 indicated by a solid line is arranged in the vicinity of the oscillating center axis 105 of the Y-axis, there is no case that the moment of inertia is increased. In this embodiment, the system is constituted such that the X-axis drive motor 82 indicated by the solid line is arranged on the base 56 and a shaft portion of the bearing portion 80 and the antenna supporting longitudinal plate 72 are fixedly secured to the X-axis drive motor 82 by way of the gear 81 and the gear 84 so as to tilt the antenna portion. The shaft 54 is supported by a bearing portion A83 and a bearing portion 55 of an antenna portion side at the opposite side of the base 56.

The weight of the drive motor and the reduction gear is sufficiently heavy compared to the weight of the antenna portion and the antenna supporting portion. Accordingly, by an arrangement of the drive motor and the reduction gear, the weight balancing is largely changed and hence, the required drive torque is changed correspondingly. The reduction of the required drive torque largely contributes to the reduction of the weight of the motor and the compacting of the device through the compacting of the motor size.

Figure 5:
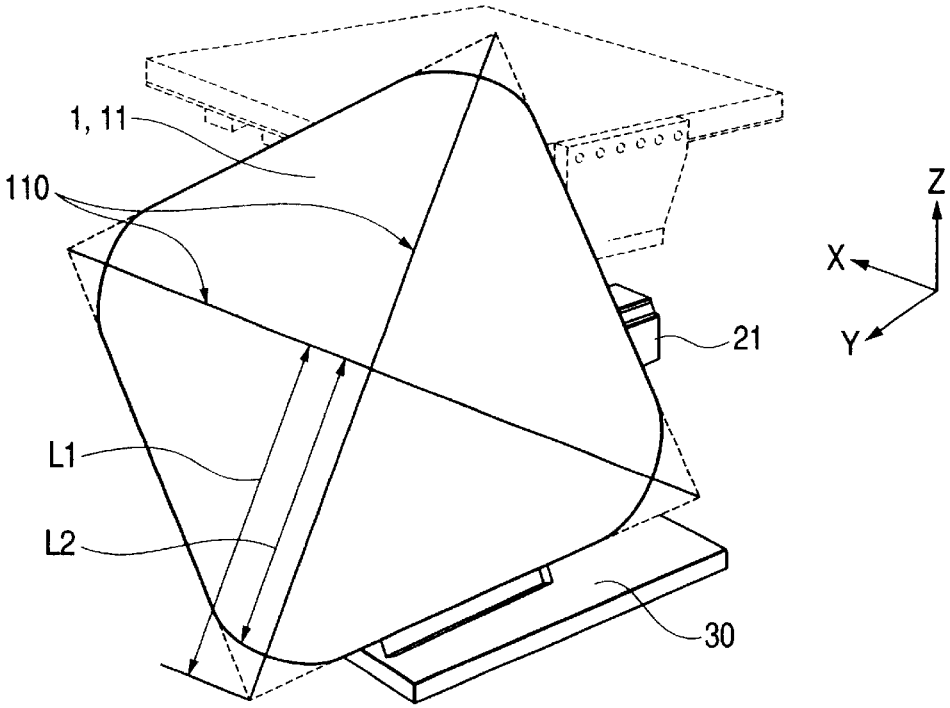
FIG. 5 is a perspective view of this embodiment of the present invention when both X-Y axes are simultaneously operated to positions in the vicinity of the operation limit.

As another embodiment of the present invention, an example where the antenna holding plate 70 of the antenna supporting portion which supports the transmission and reception antennas is formed to be circular in a disc-like shape or a shape which has four corners thereof rounded is explained. In FIG. 2, among four corners of the rectangular parallelepiped of the antenna and the antenna holding plate 70 of the antenna supporting portion which supports the transmission and reception antennas, only one place (a corner 111 shown by a broken line) is shown. Although only the operation of the X-axis is shown in FIG. 3, FIG. 5 shows a perspective view in which both X-Y axes are operated simultaneously in the vicinity of the operational limit. This embodiment is a case where four corners of the rectangular parallelepiped of the antenna and antenna holding plate 70 of the antenna supporting portion are rounded, wherein a contour line of the rectangular parallelepiped is indicated by a broken line. As can be understood from the drawing, the length when the antenna holding plate 70 of the antenna supporting portion approaches closest to the base is determined by the length (L1, L2) of a diagonal line 110 of the antenna holding plate 70 and the transmission and reception antennas 1, 11. Provided that the operational limit angle is the same, the shape which rounds four corners of rectangular parallelepiped with a diagonal line 110 having short length can, as shown in FIG. 3, make the height of the oscillating center axis 105 of the Y-axis when the antenna holding plate 70 approaches closest to the base lower than any other shape. Accordingly, the antenna supporting portion which is formed in a circular shape or has four corners thereof rounded so as to make the length of the diagonal line of the antenna holding plate 70 or the transmission and reception antennas 1, 11 short can suppress the height of the whole antenna mechanism to a low level.

Another embodiment that has separated a power transmission system of the Y-axis is shown in FIG. 6. Elements common with those of FIG. 2 are given the same reference numbers. In the embodiment shown in FIG. 2, the Y-axis drive system is arranged above the oscillating center axis 105 of the Y-axis as in the case of the X-axis. In the embodiment shown in FIG. 6, by transmitting an output from the Y-axis drive motor 21 using a belt 33, a pulley 34 and a pulley 35, the Y-axis drive motor 21 is arranged at a position other than the position above the oscillating center axis 105 of the Y axis. The Y-axis drive motor 21 and the Y-axis reduction gear 22 are fixedly secured to the base block 30 below the X-axis drive motor 51. The output of the motor is transmitted to a Y-axis shaft 29 on the oscillating center axis 105 of the Y-axis by way of the pulley 34, the belt 33 and the pulley 35. Due to such a provision, the Y-axis drive motor 21 and the portion of the Y-axis reduction gear 22 which are protruded in the negative direction of the Y axis from the oscillating center axis 105 of the Y axis in FIG. 2 can be eliminated so that the system can be made compact. It is unnecessary to arrange the reduction gear together with the motor. The reduction gear may be arranged at a transmission system portion after the pulley 35. Further, the reduction ratio may be shared by both pulleys so as to decrease the reduction ratio of the reduction gear thus enabling the use of the more compact reduction gear.

Equations which convert an elevation angle ($\phi$) and an azimuth angle ($\theta$) into rotation angles (a, b) of the Y axis and the X-axis are shown in FIG. 7. To perform a vector indication having a length r from a given elevation angle ($\phi$) and azimuth angle ($\theta$), it is expressed as a point of coordinates of X-YZ as indicated in equation 130. The conversion to obtain the same point in the equation 130 by rotating the vector on the Z axis having the length r with the rotation angle "a" about the Y axis and with the rotation angle "b" about the X axis is expressed by equation 131. Here, Rot (Y, a), Rot (X, b) are respectively conversion matrixes which are respectively expressed by equation 132 and equation 133. By putting the equation 132 and the equation 133 into the equation 131 and putting the equation 131 in order with respect to "a", "b", the elevation angle ($\phi$) and the azimuth angle ($\theta$) are converted into the rotation angles (a, b) about the Y-axis and about the X-axis respectively.

As has been described heretofore, according to the embodiments of the present invention, a two-storied constitution which arranges the Y-axis drive portion on the X axis driven side portion is not adopted but the antenna portion is supported on a fixed supporting portion by means of a oscillating mechanism which has a rotational degrees of freedom on the X-Y plane and the oscillating center axes are arranged such that they intersect on the same plane, whereby a compact and light-weight antenna mechanism which can track a communication satellite having an elevation angle ranging from the low elevation angle to the high elevation angle in the zenith direction from the traveling mobile body can be constituted.

Further, by arranging the drive mechanism such as the drive motor on the oscillating center axis, an advantageous effect that the drive system can be made compact and light-weight and hence, the weight load at the time of mounting the system on the mobile body can be reduced is obtained.

Further, by forming the antenna supporting portion into a circular shape or rounding four corners of the antenna supporting portion, the interference region between the base and the antenna supporting portion can be reduced whereby an advantageous effect that the operable range can be expanded and the height of the device is reduced is obtained.

Further, since replaceable adapters can change the distance between the antenna and the oscillating center axis, the adjustment of the tracking operation range can be facilitated and maintenance characteristics can be enhanced.

As has been described heretofore, according to the present invention, a small-sized and light-weight satellite tracking device which can track a communication satellite from the low elevation angle to the high elevation angle in the zenith direction on the traveling mobile body can be attained.

What are claimed is:

1. An antenna drive device, comprising:

an antenna portion having at least one antenna enabling at least one of transmission and reception;

an antenna supporting portion supporting the antenna portion;

a fixed supporting portion supporting the antenna drive device;

an oscillating mechanism disposed between the antenna portion and the fixed supporting portion and having rotational degrees of freedom on an X-Y plane parallel to a plane of the antenna, the oscillating mechanism having a first oscillating mechanism portion including a motor which enables tilting of the antenna portion and the antenna supporting portion about a first oscillating axis, and a second oscillating mechanism portion which enables tilting of the first oscillating mechanism portion relative to the fixed supporting portion about a second oscillating axis, a center of gravity of the first oscillating mechanism portion being disposed in the vicinity of the second oscillating axis.

2. The antenna drive device according to claim 1, wherein the second oscillating mechanism portion includes bearings supporting the second oscillating axis, the motor being positioned between the bearings.

3. The antenna drive device according to claim 1, wherein the first oscillating axis of the first oscillating mechanism portion is constituted by a shaft of the motor extending in opposite directions from the motor.

4. The antenna drive device according to claim 1, wherein the antenna supporting portion includes adapters disposed between the antenna portion and the first oscillating axis.

5. The antenna drive device according to claim 1, wherein the antenna supporting portion of the antenna portion for holding the antenna has at least one of a circular shape and rectangular shape with rounded corners.

6. The antenna drive device according to claim 1, further comprising:

a controller which converts command values in a form of an azimuth angle and an elevation angle into tilting angles of the first and second oscillating axes.

7. An artificial satellite tracking system comprising antennas which transmit and receive radio waves with respect to an artificial satellite, an antenna drive mechanism which drives the antennas with rotational degrees of freedom on an X-Y plane parallel to an antenna plane, a control part which controls the antenna drive mechanism in response to signals received by the antennas, and communication equipment which enables communication with the artificial satellite through the antennas, wherein the antenna drive mechanism includes an antenna holding portion which holds the antennas, supporting legs which supports the antenna holding portion, an X-axis base portion which tiltably holds the antennas through the supporting legs, an X-axis drive motor which is mounted in a space delimited by the supporting legs on the X-axis base portion and drives the supporting legs, and a fixed supporting portion which has an oscillating mechanism which tilts the X-axis base portion relative to a Y axis which passes through the X-axis drive motor.

8. A mobile vehicle comprising a mobile vehicle body with the artificial satellite tracking system of claim 7 mounted thereon.

9. An antenna drive device, comprising:

an antenna portion having an antenna enabling at least one of transmission and reception;

an antenna supporting portion supporting the antenna portion;

a fixed supporting portion supporting the antenna drive device;

an oscillating mechanism disposed between the antenna portion and the fixed supporting portion and having rotational degrees of freedom on an X-Y plane parallel to a plane of the antenna, the oscillating mechanism having a first oscillating mechanism portion oscillating the antenna portion and the antenna supporting portion about a first oscillating axis, and a second oscillating mechanism portion oscillating the first oscillating mechanism portion relative to the fixed supporting portion about a second oscillating axis, the first oscillating mechanism having a motor to oscillate the antenna supporting portion, and the second oscillating mechanism having bearings supporting the second oscillating axis with the motor being positioned between the bearings.

10. The antenna drive device according to claim 9, wherein a center of gravity of the first oscillating mechanism portion is disposed in the vicinity of the second oscillating axis.

11. The antenna drive device according to claim 9, wherein the first oscillating axis and the second oscillating axis intersect one another.

12. The antenna drive device according to claim 11, wherein antenna supporting portion comprises two legs for supporting the antenna portion, and the motor of the first oscillating mechanism is disposed between the two legs.

13. The antenna drive device according to claim 12, wherein the first oscillating axis is constituted by a shaft of the motor which extends in opposite directions from the motor.

14. The antenna drive device according to claim 9, wherein the first oscillating axis is constituted by a shaft of the motor which extends in opposite directions from the motor.

* * * * *